US005564897A

United States Patent [19]

Månsson

[11] Patent Number: 5,564,897

[45] Date of Patent: Oct. 15, 1996

[54] AXIAL TURBO-MACHINE ASSEMBLY WITH MULTIPLE GUIDE VANE RING SECTORS AND A METHOD OF MOUNTING THEREOF

[75] Inventor: Martin Månsson, Finspong, Sweden

[73] Assignee: ABB Stal AB, Finspong, Sweden

[21] Appl. No.: 313,133

[22] PCT Filed: Mar. 30, 1993

[86] PCT No.: PCT/SE93/00273

§ 371 Date: Sep. 30, 1994

§ 102(e) Date: Sep. 30, 1994

[87] PCT Pub. No.: WO93/20334

PCT Pub. Date: Oct. 14, 1993

[30] Foreign Application Priority Data

Apr. 1, 1992 [SE] Sweden ..... 9201083

[51] Int. Cl.[6] ..... F01D 9/04; F04D 29/64

[52] U.S. Cl. ..... 415/190; 415/209.2; 29/889.22

[58] Field of Search ..... 415/189, 190, 415/199.5, 209.1, 209.2, 209.3, 209.4; 29/889.22

[56] References Cited

U.S. PATENT DOCUMENTS

| | | | |
|---|---|---|---|
| 2,445,661 | 7/1948 | Constant et al. | 415/209.3 |
| 2,625,367 | 1/1953 | Rainbow et al. | 415/209.3 |
| 3,817,655 | 6/1974 | Huesgen et al. | 415/209.3 |
| 3,824,034 | 7/1974 | Leicht | 415/209.2 X |
| 3,892,497 | 7/1975 | Gunderlock et al. | 415/209.3 |
| 4,218,180 | 8/1980 | Wikstrom | 415/209.3 X |
| 4,384,822 | 5/1983 | Schweikl et al. . | |
| 4,623,298 | 11/1986 | Hallinger et al. . | |
| 4,648,792 | 3/1987 | Baran, Jr. et al. . | |
| 5,127,797 | 7/1992 | Carman | 415/209.2 |

FOREIGN PATENT DOCUMENTS 7708074 7/1979 Sweden .

*Primary Examiner*—Edward K. Look
*Assistant Examiner*—Michael S. Lee
*Attorney, Agent, or Firm*—Pollock, Vande Sande & Priddy

[57] ABSTRACT

The invention relates to a method and a device for mounting an axial turbo-machine, preferably a low-pressure compressor for a gas turbine, constructed without a parting line with a whole or constructed rotor. From the design point of view, problems arise regarding the mounting of the stationary guide vane rings in the case of a design without a parting line and a whole rotor. The problem is solved by dividing the guide vane rings into sectors in a number greater than two. These sectors are brought radially into position and are guided and fixed in the correct position by guide rings which are applied around each guide vane ring composed from sectors. Each composed guide vane ring with the surrounding guide ring is guided and fixed to the preceding guide ring and all the guide vane rings are successively built up around the whole or constructed rotor. The guide rings mounted together constitute a stiff annular element.

13 Claims, 3 Drawing Sheets

AXIAL TURBO-MACHINE ASSEMBLY WITH MULTIPLE GUIDE VANE RING SECTORS AND A METHOD OF MOUNTING THEREOF

TECHNICAL FIELD

The invention relates to axial turbo-machines, preferably low-pressure compressors for gas turbines and to a method and a device for mounting of a machine concept without a parting line and with a non-divisible rotor.

BACKGROUND OF THE INVENTION

When designing axial turbo-machines comprising a bladed rotor in several stages and partitions comprising stationary guide vanes, an axial parting line is preferably chosen. The housing of the turbo-machine is thus given a top half and a bottom half, which are bolted together in the parting line by means of flanges. The partitions, which contain the stationary guide vanes, are divided into two halves, one half being placed in the bottom half of the housing where it is aligned and centered by means arranged between the wall half and the housing. The bladed rotor is placed in its bearing positions in the ends of the bottom half, the rotor discs then being situated between the mounted partitions of the bottom half. The other partition halves are mounted in the top half of the housing, The principle described above is the most frequently used. However, depending on the type of turbo-machine, it is a question of partitions in the form of plates with a relatively low (a small radial extent) guide vane channel to the extreme case involving guide vane lattices attached to the inside of the housing without any wall construction. Action type steam turbines have marked partitions whereas guide vane lattices for a gas turbine compressor can only comprise guide vanes attached to the inner walls of the compressor housing with or without any connecting element at the inner limit of the guide vanes nearest the rotor shaft.

The parting line entails an accumulation of material and a departure from the rotational symmetry, which is a drawback upon start-up and load changes. Uneven temperature heating arises, which above all causes ovalities. To prevent this from giving rise to cutting between stationary parts and parts of the rotating rotor, enlarged clearances in the flow channel are required, which causes major leakage and inferior performance of the machine. The negative effect of parting lines is minimized either by minimizing the amount of material in the parting line by constructing in high-strength material with thin thicknesses (gas turbines for aircraft) or choosing to change the load of the turbine slowly (large steam turbines for high pressures and cast housings).

Parting lines are sensitive to leakage, which means that the necessary stiffness requires a certain amount of material in the flanges. Consequently, there is a reason for designing turbo-machinery completely rotationally symmetrically without parting lines. From the design point of view the problem then arises how to proceed to mount the stationary lattices between the rotor stages. One known turbine concept comprises high-pressure turbines which are of the so-called barrel type, that is, they have no parting lines. Such a turbine is composed of an inner housing, composed of axially mounted rings screwed together, which fix the partitions which in turn are divided into two halves and inserted radially into their positions and locked there by the above-mentioned rings. The ring package is guided by guiding elements in the surrounding cast turbine housing.

When designing an axial turbo-machine, preferably a gas turbine, it is advantageous also to avoid parting lines to obtain a rotationally symmetrical design.

Constructively, the mounting problem has been solved by using built rotors, which when mounting the machine are built up step-by-step successively with whole guide vane rings sandwiched in between (in the above steam turbine application referred to as partitions). This method is technically applicable.

However, it would entail technical and economic advantages if it were possible to use non-divisible rotors while at the same time utilizing a design without a parting line.

For axial turbo-machines, preferably high-pressure compressors for gas turbines, this is possible since it is possible to mount the guide vane rings guide vane by guide vane in the housing, the boundary of the guide vane nearest the rotor shaft being free and without any structural member which interconnects the guide vane tips. The limitation that this design entails has to do with oscillations and is dealt with by the guide vanes being short as compared with their chord.

With regard to an axial turbo-machine, preferably a low-pressure compressor for a gas turbine, the guide vanes are of such a length that the free attachment mentioned above creates problems from the point of view of oscillation. A constructive design could be guide vanes with large chords, which, however, entails a longer machine. In the case of non-constant speed machines, the oscillation problems in blade and guide vane lattices are difficult to overcome and require accurate calculations and advanced design solutions. Design solutions with good damping properties are desired.

SUMMARY OF THE INVENTION

An axial turbo-machine, preferably a low-pressure compressor for a gas turbine, is constructed without parting lines and the rotor 24 is mounted together with the static components in undivided state. The guide vane rings are divided into sectors 9 of a number greater than two. The sectors are inserted radially into their correct position. By means of axial guide pins 12 or other fixing elements, the sectors are fixed in the correct angular position in the plane perpendicularly to the direction of the rotor shaft. Between the sectors, space is provided for the thermal expansion of the sectors.

Axially and radially the sectors are fixed by whole guide rings (e.g. 13, 14), which are mounted axially in relation to each other, fixed via axial bolts or other types of fixing elements and guided towards each other radially by means of guide surfaces (e.g. 15, 26) or some other guiding principle, for example by axial pins. The amount of material in the guide rings is adapted such that the heating rate and the thermal expansion thus obtained follow the corresponding heating and thermal expansion of the rotor upon start-up and load changes.

Since the guide rings constitute a stiff structural member, the faster heating of the sectors following a load change, and the thermal expansion thus obtained, will not give rise to the sectors expanding radially outwards, but they will make use of the above-mentioned gaps between the sectors and will expand inwards towards the rotor shaft. The limiting surface towards the rotor shaft, commonly formed by the sectors, exhibits small deviations from the circular shape, which appears in a uniformly heated machine.

The sectors, the outer and inner boundaries of which consist of interconnecting elements 6, 7, create oscillation-damping units and, in addition, at the attachment of the guide vanes to the interconnecting elements, damping material can be enclosed to further improve the damping ability of the sectors.

DETAILED DESCRIPTION OF THE PREFERRED EMBODIMENT

Figure 3:
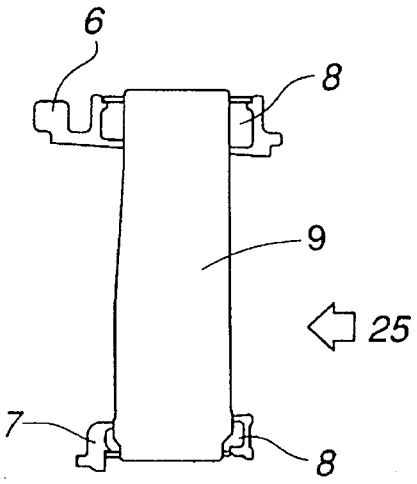
FIG. 3 shows a sector of guide vanes with outer and inner interconnecting structural members.
Figure 4:
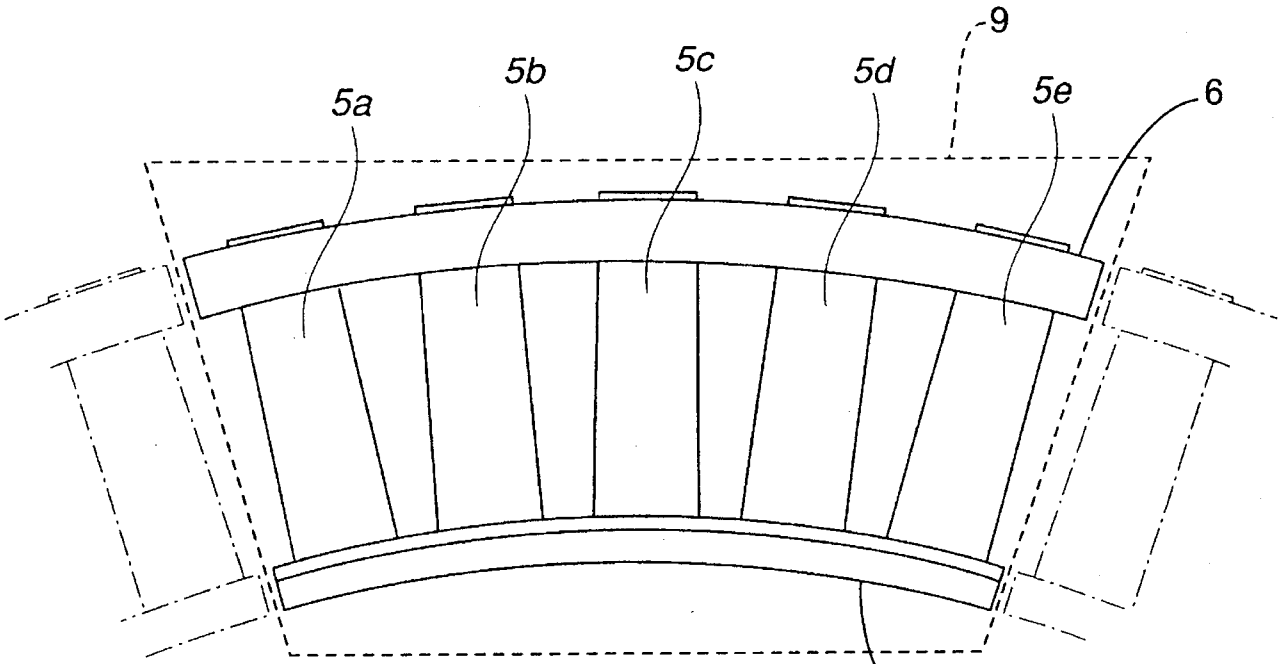
FIG. 4 shows the sector according to FIG. 3, seen axially in the direction of the arrow 25. The sector shown comprises five guide vanes.

After manufacture, guide vanes 5 and attachment elements 6, 7 at both their ends constitute a whole in the form of an annular structural member. This is referred to as a guide vane ring. This ring is divided by means of radial sections into a number of sectors 9, the number being greater than two. FIGS. 3 and 4 show such a sector in two views. In this example the sector comprises five guide vanes *5a–5e*, held together by an outer structural member 6 and an inner structural member 7. The structural members 6, 7 enclose a damping material 8.

Figure 2:
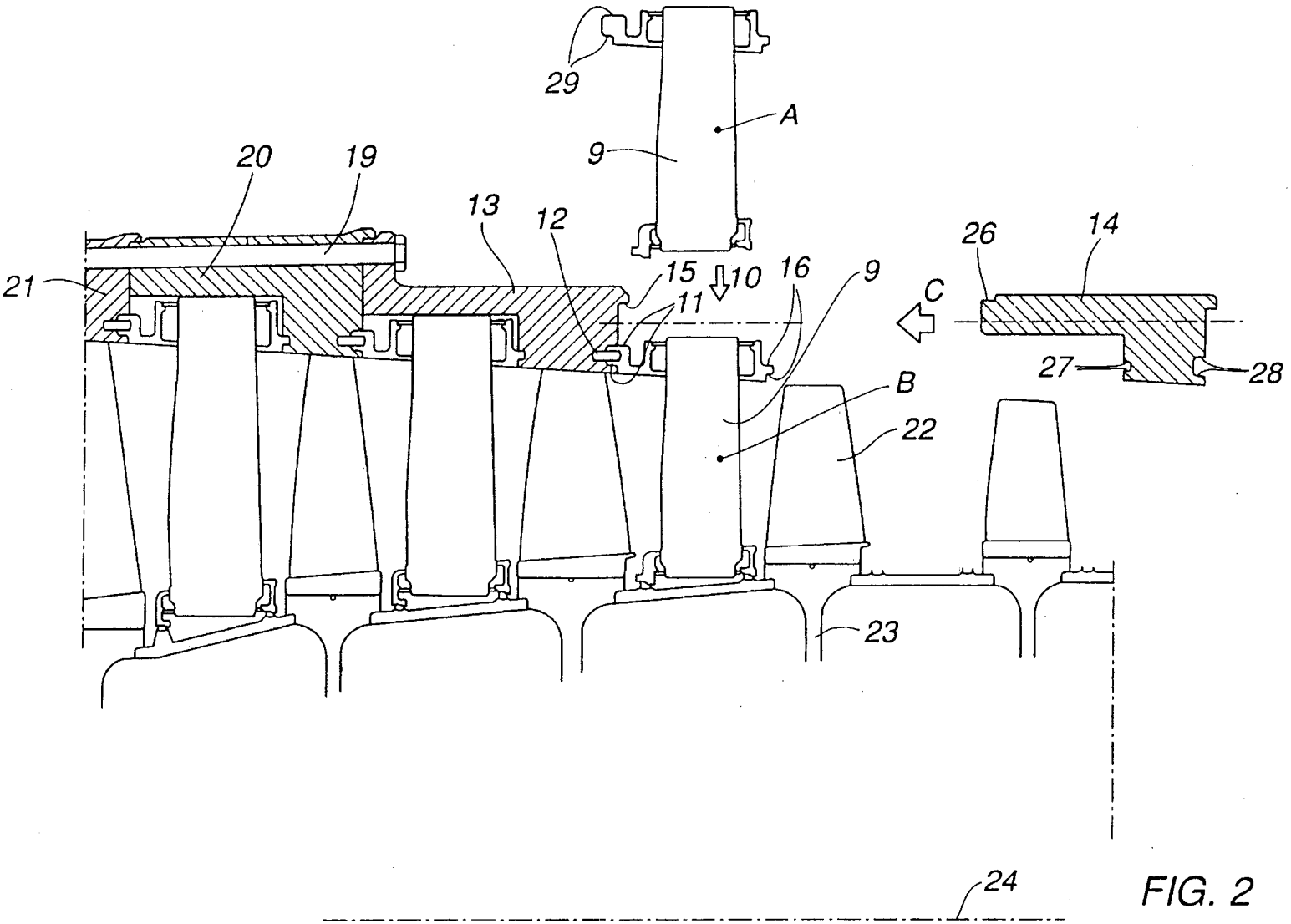
FIG. 2 shows an enlarged part of the flow channel in FIG. 1 (dash-dotted square). The figure shows a design example with such an embodiment that the inventive concept can be applied.

FIG. 2 shows a sector 9 of a guide vane ring in a position A, from which position A the sector 9 is inserted radially according to the arrow 10 into a position B. The insertion also comprises an axial displacement into a guide means 11 and over a guide pin 12. The guide pin 12 fixes the sector in the correct angular position in the plane perpendicular to the direction of the rotor shaft. The guide means 11 fixes the sector radially. The guide vane sector 9 is fixed radially by the guide means 11 in the guide ring 13. After all the sectors of the guide vane ring have been fixed in relation to the guide ring 13, the guide ring 14 is moved axially in the direction of the arrow C in over the mounted sectors, is guided against the guide surfaces 15, 16 and pressed against the guide ring 13. Thereby, the sectors 9 are now fixed radially in the two guide surfaces 29 and 16 of the structural outer member 6 in the guide surface 11 of the guide ring 13 and the guide surface 27 of the guide ring 14. The guide ring 14 is guided with its guide surface 26 against the guide surface 15 on the guide ring 13 and is thus radially guided against the preceding guide ring, here guide ring 13. With guide ring 14 axially in contact with guide ring 13, the sectors 9 are axially fixed. With guide ring 14 in mounted position, the mounting of the sectors included in the next guide vane ring is started, which is performed in the same way as described above.

Figure 1:
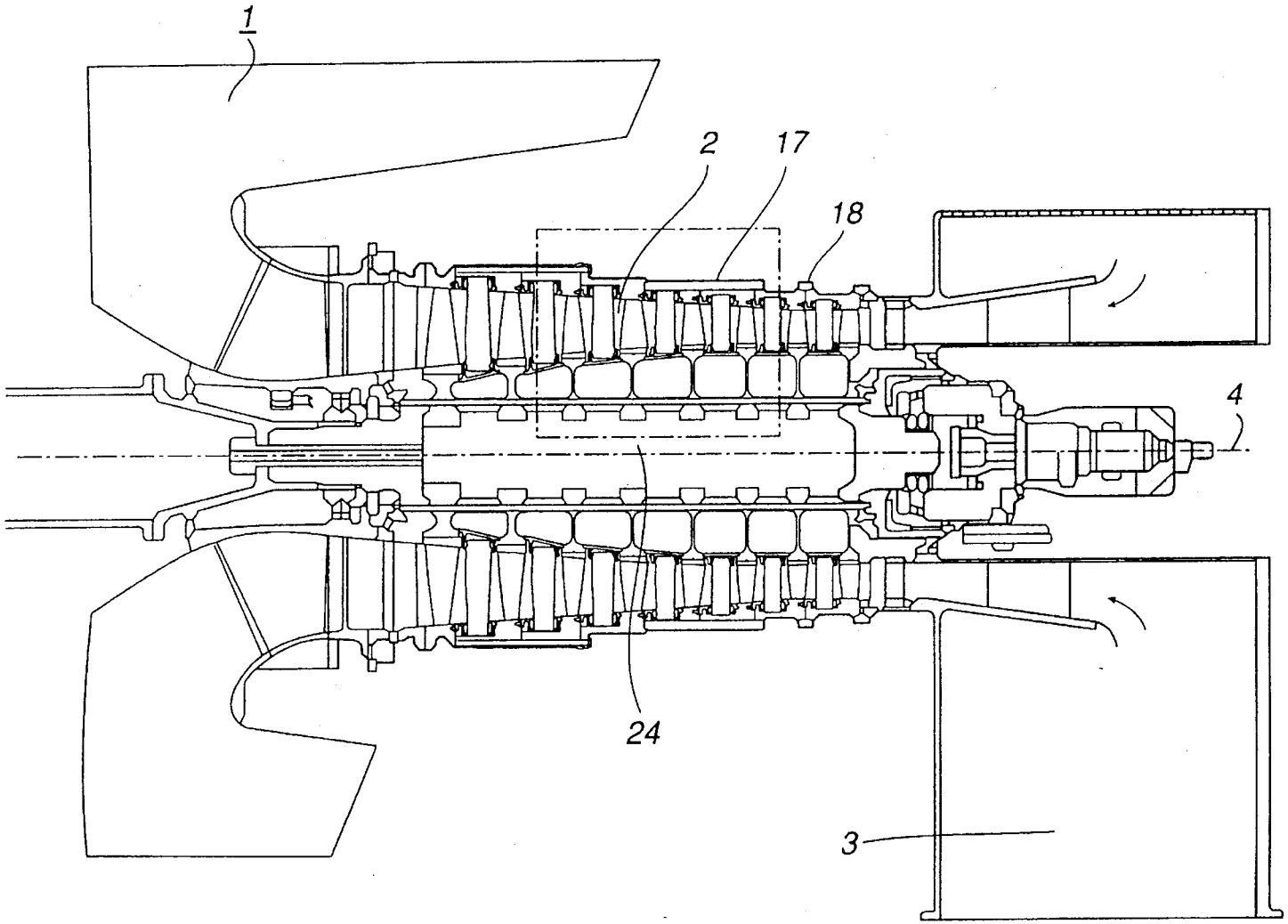
FIG. 1 shows a sectional view of an axial low-pressure compressor for a gas turbine with an air inlet at 1, a flow channel at 2 and an outlet at 3. The center line of the rotor shaft is designated 4. The rotor 24 is, according to the figure, constructed from individual units which are bolted together to form a rotor body. According to the invention, the rotor may be made in one piece.

The guide rings included in the compressor are bolted together axially in groups of rings or individually, which fixes the guide rings axially. This is clear from FIG. 1, in which the bolted joint 17 interconnects three guide rings whereas the bolted joint 18 only fixes the succeeding guide ring to the preceding one. FIG. 2 shows a bolted joint 19 which interconnects guide rings 13, 20, 21 and further ring elements (not shown). Numeral 22 designates a blade mounted on the rotor disc 23. Numeral 24 designates the center line of the rotor.

I claim:

1. A method of mounting an axial turbo-machine assembly in a gas turbine constructed with a housing without a parting line, said method comprising the steps of:

forming a plurality of radial sectors, each said sector including a plurality of vanes;

bringing at least three said sectors radially into a position to form a vane ring which encloses a rotor of said assembly; and applying a guide ring around an outer surface of said vane ring for fixing each said sector in said position.

2. A method according to claim 1, further comprising fixing said guide ring axially by at least one fastener.

3. A method according to claim 1, further comprising displacing said sectors axially towards a previously mounted vane ring after each said sector is radially brought into said position, and fixing each said sector radially in said previously mounted vane ring by at least one guide.

4. A method according to claim 3, wherein said fixing includes fixing angularly each said sector in a plane perpendicular to the direction of a rotor shaft which is a rotational center of said assembly.

5. A method according to claim 1, wherein said applying step includes fixing each said sector axially by said guide ring.

6. A method according to claim 1, further comprising providing guide surfaces in said guide ring and in said sectors, and fitting at least one guide surface of said guide ring with at least one guide surface of said sectors for fixing said sectors radially.

7. An axial turbo-machine assembly in a gas turbine, comprising:

a multiple of vane rings for enclosing a rotor of said assembly, wherein each said vane ring is formed by at least three radial sectors spaced apart from each other, each said sector comprising at least two vanes and expanding independently of the remaining sectors of said vane ring in a radial inward direction due to heat in said gas turbine; and a guide ring applied around an outer surface of each vane ring for radially and axially fixing each said sector in a proper position in said assembly.

8. An assembly according to claim 7, further comprising fastening means for axially fixing each said sector in said proper position.

9. An assembly according to claim 7, wherein said sectors are axially displaceable towards a previously mounted vane ring after each said sector is radially brought into said position to form said vane ring, and further comprising at least one guide for radially fixing said sectors in said previously mounted vane ring.

10. An assembly according to claim 9, wherein each said sector is fixed angularly in a plane perpendicular to the direction of a rotor shaft which is a rotational center of said assembly.

11. An assembly according to claim 7, wherein each said sector is axially fixed by said guide ring.

12. An assembly according to claim 7, further comprising guide surfaces located in said guide ring and in said sectors, wherein at least one said guide surface of said guide ring is fitted with at least one guide surface of said sector for fixing said sector radially.

13. An axial turbo-machine assembly in a gas turbine, comprising:

a plurality of vanes divided into at least three radial sectors which form a vane ring, wherein each said sector comprises a plurality of said vanes and expands independently of the remaining sectors of said vane ring in a radial inward direction due to heat in said gas turbine; and a guide ring applied around an outer surface of said vane ring for fixing said sectors in a proper position in said assembly.

* * * * *